US005731080A

United States Patent [19]

Cousin et al.

[11] Patent Number: 5,731,080

[45] Date of Patent: Mar. 24, 1998

[54] HIGHLY LOADED FIBER-BASED COMPOSITE MATERIAL

[75] Inventors: Laurent Cousin, Annecy le Vieux; Fernand Mora, Frangy, both of France

[73] Assignee: International Paper Company, Purchase, N.Y.

[21] Appl. No.: 342,680

[22] Filed: Nov. 21, 1994

Related U.S. Application Data

[63] Continuation of Ser. No. 44,234, Apr. 7, 1993, abandoned.

[30] Foreign Application Priority Data

Apr. 7, 1992 [FR] France ..... 92 04474

[51] Int. Cl.[6] ..... B32B 5/16; D02G 3/00

[52] U.S. Cl. ..... 428/372; 106/464; 162/145; 162/146; 162/181.1; 428/220; 428/283; 428/402

[58] Field of Search ..... 106/214, 464; 162/135, 145, 146, 158, 168.1, 175, 181.1; 428/113, 372, 402, 220, 229, 240, 283

[56] References Cited

U.S. PATENT DOCUMENTS

| | | | |
|---|---|---|---|
| 2,583,548 | 1/1952 | Craig | 106/204 |
| 4,405,744 | 9/1983 | Greinecker et al. | 524/423 |
| 4,493,751 | 1/1985 | Cherdron et al. | 162/157.2 |
| 4,892,590 | 1/1990 | Gill et al. | 106/214 |
| 4,952,278 | 8/1990 | Gregory et al. | 162/141 |
| 5,091,055 | 2/1992 | Fredeanucci et al. | 162/135 |
| 5,096,539 | 3/1992 | Allan | 162/9 |
| 5,223,090 | 6/1993 | Klungness et al. | 162/9 |

FOREIGN PATENT DOCUMENTS

| | | | |
|---|---|---|---|
| A 0227853 | 7/1987 | European Pat. Off. | D21H 5/00 |
| A 9009483 | 8/1990 | WIPO | D21H 17/70 |
| A 9215754 | 9/1992 | WIPO | D21H 17/70 |

*Primary Examiner*—Marion E. McCamish
*Assistant Examiner*—Blaine R. Copenheaver
*Attorney, Agent, or Firm*—Ostrager, Chong & Flaherty

[57] ABSTRACT

The present invention relates to a novel composite product which is composed of a fibrocrystalline heterogeneous structure consisting of:

on the one hand a plurality of fibers of expanded specific surface area and of hydrophilic character, having a substantial quantity of microfibrils on their surface, and on the other hand crystals of precipitated calcium carbonate (PCC), organized essentially in clusters of granules, the majority of which trap the microfibrils and are joined directly thereto by mechanical bonding.

10 Claims, 11 Drawing Sheets

HIGHLY LOADED FIBER-BASED COMPOSITE MATERIAL

This is a continuation of application Ser. No. 08/044,234 filed on Apr. 7, 1993 now abandoned.

The present invention relates to the field of fiber-based products into which it is necessary to incorporate fillers, generally mineral fillers, in order to give them certain physical properties or else to reduce their manufacturing cost.

Examples which should be mentioned are materials employed especially in the field of construction and possessing properties of stability, inertness and flame resistance, which can be used in the form of panels, boards, sheets, tiles or bricks.

The field of papermaking for the production of printing/writing papers, decorative papers, flame-resistant papers, etc. should also be mentioned.

There has long been a perceived need for such products and the prior art has known various processes for obtaining them. It can be considered that the manufacturing technique consists mainly in producing a suspension, generally an aqueous suspension, of partially refined fibers into which a filler of finely divided mineral products, such as calcium carbonate having for example a particle size of between 0.5 and 10 micrometers, is introduced.

The problem which has to be solved in such a technique is that of the bonding between the fibers and the mineral fillers, so that the product obtained after at least partial removal of the aqueous medium has a strength or a cohesion which is in keeping with the stresses, generally mechanical stresses, borne during use.

To date, the only effective method employed consists in incorporating into the suspension one or more retention aids, the purpose of which is to bond the mineral fillers to the fibers. As an example, polyacrylamide is commonly used to bond calcium carbonate to cellulose fibers.

For the bonding function, such a technique can be considered satisfactory, even though it is subject to a limit in the percentage of fillers incorporated. On the other hand, such a technique suffers from certain disadvantages which it would be particularly desirable to eliminate.

The first disadvantage concerns the appreciable extra production cost due to the presence of the retention aid or aids, which are expensive products.

The second disadvantage is due to the fact that the dewatering process, or process of removal of the aqueous phase, entrains a significant proportion of the retention aid or aids as well as the mineral fillers, which are definitively lost. This results in an economic loss which can be qualified as substantial, and also, above all, in environmental pollution which can only be combated by resorting to an effluent purification plant.

The setting-up and functional maintenance of such a plant again have an adverse effect on the economic balance of the production of such products.

The presence of the retention aid or aids is also responsible for degrading the look-through of the base in the field of papermaking.

Another known technique for incorporating mineral fillers into a fibrous cellulosic substrate is the one described in International patent application WO 92/15 754, published after the priority date of the present patent application.

This intercalated patent application discloses a process which consists in subjecting a pulp of cellulose fibers, free of water and qualified as crumb pulp, containing from 40 to 95% by weight of water, to a treatment in which it is brought into contact with lime and in which gaseous $CO_2$ is injected into the lime-treated pulp inside a pressurized refiner. This treatment makes it possible to obtain a filler of crystalline $CaCO_3$ localized essentially in the lumen and the wall of the cellulose fibers.

It should be noted that the treatment is carried out in a dry medium and not an aqueous liquid medium. Furthermore, the composite product obtained is characterized by localization of most of the crystalline $CaCO_3$ within the fibers.

Consequently the $CaCO_3$ loading of the papers obtained from said pulp remains relatively limited (less than 20%), which is of the order of those achieved by the loading techniques using retention aids.

One object of the present invention is to overcome the above disadvantages by proposing a novel composite product based on fibers and fillers which satisfies the pursuit of properties referred to above and can be obtained without resorting to the retention aids normally used.

A further object of the present invention is to permit the production of even a highly loaded composite product, in the sense generally understood by such an expression, especially in the field of papermaking, i.e. a composite product in which the mineral loading exceeds 50% by weight of total solids.

The invention further relates to a process for obtaining such a novel composite product capable of being used for different applications.

The novel composite product according to the invention is composed of a fibrocrystalline heterogeneous structure consisting of:

on the one hand a plurality of fibers of expanded specific surface area and of hydrophilic character, having a substantial quantity of microfibrils on their surface, these microfibrils preferably having a diameter of less than 5 μm, and on the other hand crystals of precipitated calcium carbonate (PCC), organized in clusters of granules which trap the microfibrils and the majority of which are joined directly thereto by mechanical bonding.

The present invention further relates to a process of the type comprising essentially the following steps:

the bringing of microfibrillated fibers into contact, in an aqueous medium and with moderate agitation, with calcium ions, $Ca^{++}$, introduced by way of lime, and the addition, with vigorous agitation, of carbonate ions, $CO_3^{--}$, introduced indirectly by the injection of carbon dioxide, $CO_2$, in which process, before the addition of $CO_2$:

the suspension of microfibrillated fibers and lime is diluted to a solids concentration which is less than or equal to 5, preferably less than or equal to 4 and particularly preferably of the order of 2.5% by weight, and the suspension is stabilized at a temperature of between 10° and 50° C., so as to effect in fine crystallization of $CaCO_3$ (PCC) in situ, essentially organized in granular clusters of PCC crystals, the majority of which trap the micro-fibrils and are joined directly thereto by mechanical bonding.

Various other characteristics of the subjects of the invention will become apparent from the detailed description which follows.

Embodiments of the novel composite product are given with reference to the attached diagrams.

Figure 1:
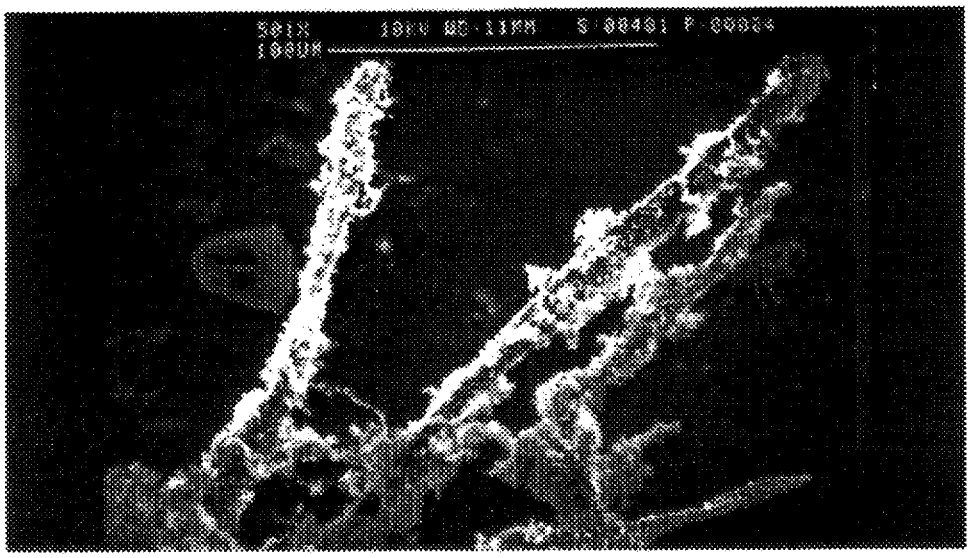
FIGS. 1 to 3 are scanning electron microscope (SEM) photographs, at different magnifications, of the structure of a composite product based on eucalyptus cellulose fibers refined to 40° SR.
Figure 2:
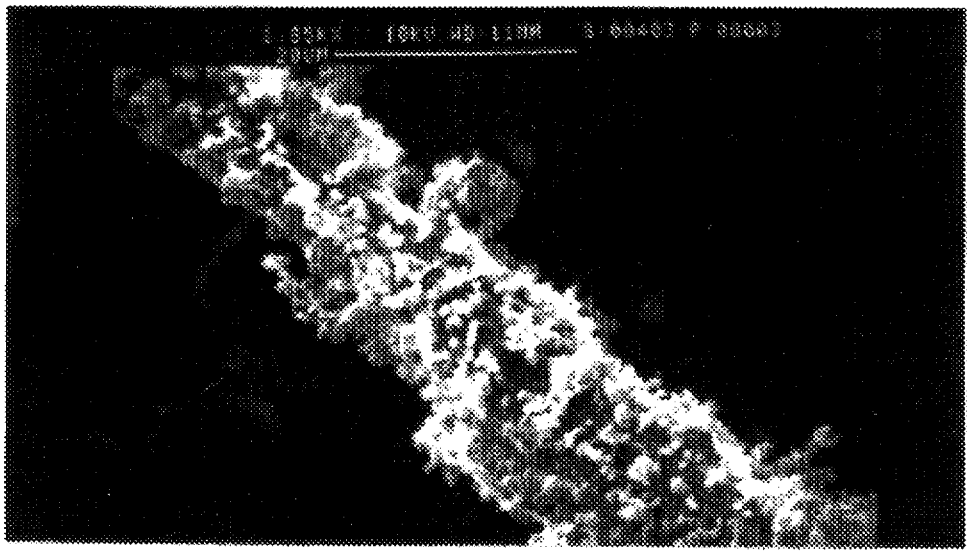
Figure 3:
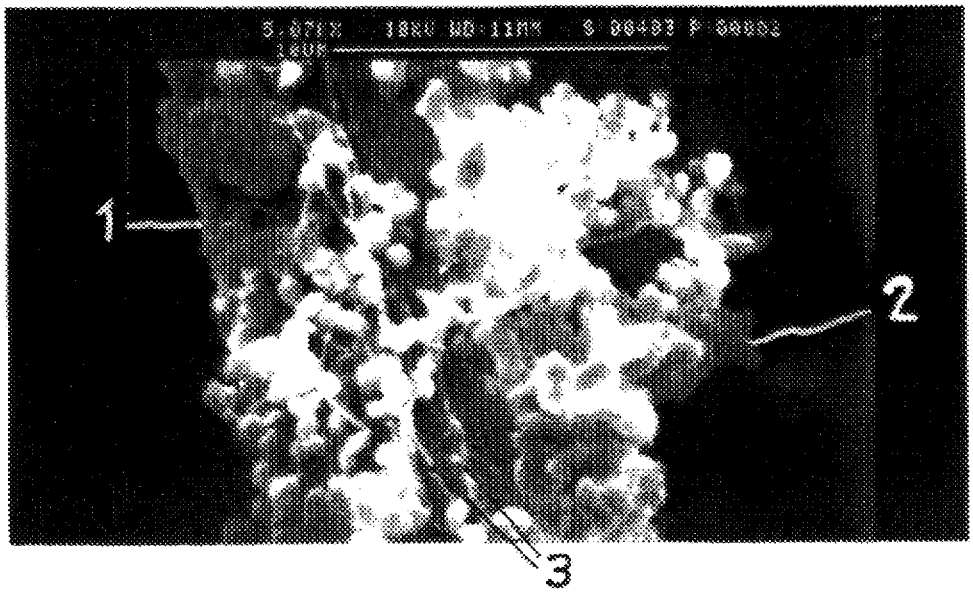

FIGS. 1 to 3 show, at respective magnifications of 501, 1850 and 5070, that the novel composite product according to the invention is composed of a fibrous structure formed of a mat of elementary fibers 1 of hydrophilic character which, naturally or through treatment, have a certain specific surface area. The latter is a function of the number of microfibrils 3 with which the surface of each fiber 1 is provided. This assembly of microfibrils can either exist naturally or be obtained by a treatment such as refining (fibrillation), which consists in passing the fibers between the plates or discs of a refiner according to a conventional procedure.

The fibrous structure has the characteristic of carrying crystals 2 of precipitated calcium carbonate (PCC) which are uniformly distributed and directly grafted on to the microfibrils 3, preferably without an interface or the presence of a binder or retention aid. It is important to note that these crystals are organized in clusters of granules, the majority of which trap the microfibrils by reliable and non-labile mechanical bonding.

Figure 26:
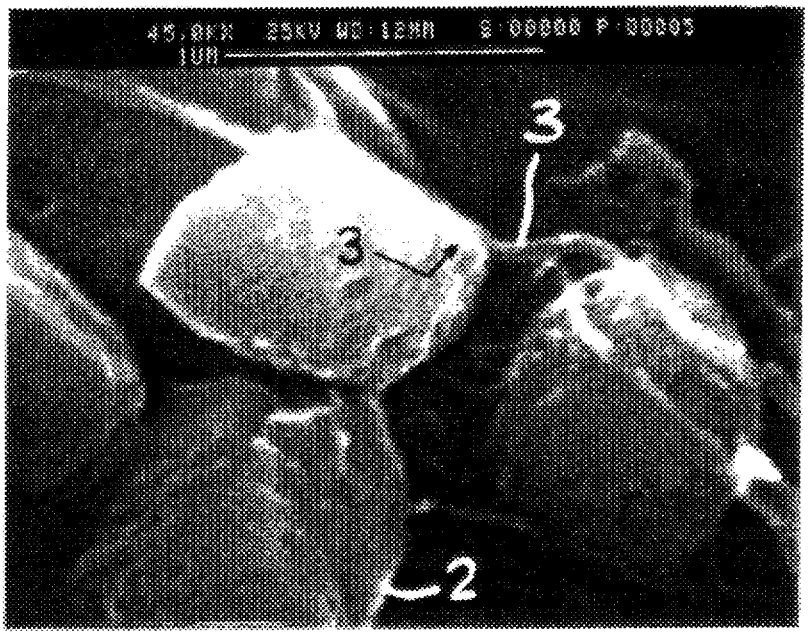
FIGS. 26 to 28 are SEM photographs, at different magnifications greater than those used in the above photographs, of granules of PCC crystals trapping microfibrils.
Figure 27:
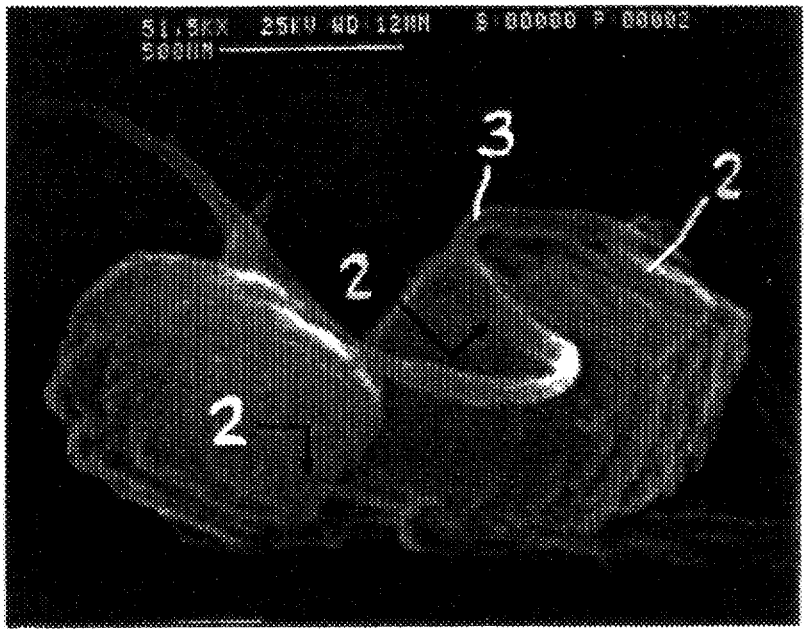
Figure 28:
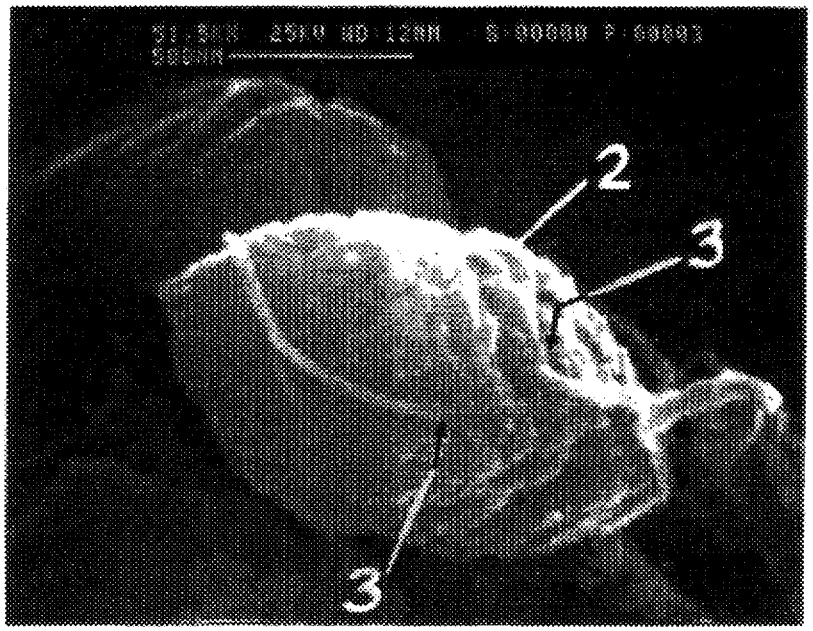

By way of illustration, FIG. 26, at a magnification of 45,000×, and FIGS. 27 and 28, at magnifications of 51,500× show granules of PCC crystals 2 mechanically bonded to the microfibrils 3. The latter are thus trapped in the mass of granules.

It was possible to deduce the fine structure of the granule/microfibril bond by extrapolation, especially with the aid of the test described below.

The principle of the test is based on evaluating the quantity of non-hydrolyzable cellulose, i.e. cellulose assumed to be trapped in the mass of granules, in a composite product according to the invention containing 25% by weight of cellulose refined to 95° SR and 75% by weight of PCC.

The methodology of the test is as follows:

1- Manufacture of a composite product by the process according to the invention.

2- Exhaustive enzymatic attack on the composite product: selective enzymatic hydrolysis of the cellulose at 40° C. and pH 7, for 6 days, with cellulases (CELLUCLAST 1.5 L at 500 IEU/g and NOVOZYM 342 at 500 IEU/g, both marketed by NOVO ENZYMES).

3- Study of the enzymatic hydrolysis residue:

a) Ash content at 400° C.=93.8% on a dry weight basis. It can be deduced from this that the hydrolysis residue comprises about 5% of non-mineral products.

b) Analysis of the 93.8% of ash by cobalt nitrate staining: the mineral part of the hydrolysis residue consists of 100% of calcite.

c) The enzymatic hydrolysis residue is treated with dilute hydrochloric acid at a controlled pH of around 7. The $CaCl_2$ produced is removed by ultrafiltration and the residue is analyzed by gas chromatography after acid hydrolysis according to the method of SAEMAN (TAPPI 37(8), 336–343) and conversion of the monomers obtained to alditol acetate. This analytical technique makes it possible to assay the quantity of neutral oses present in a sample. It was thus possible to determine that 3% by weight of the starting cellulose is inaccessible to the enzymes and in all probability is trapped inside the granules of PCC, for example as shown in FIGS. 26 to 28.

Such an organization differs from those of numerous known mineral fillers, whose crystals form flocs of larger or smaller dimensions when they are integrated into the fibrous network, this integration being effected in the presence of retention aids. Such a structure does not generally make it possible to have a resistant and durable retention of the filler on the fibers, because of its brittleness.

The novel composite product can have different forms of presentation, such as:

an aqueous suspension representing an intermediate state of conversion or use, a paste with a moisture content of about 60%, for example, also representing an intermediate state of conversion, a compact mass with a low water content, for example of about 5%, representing an intermediate state of conversion or definitive state of use, a processed product into which the composite product is incorporated after conversion.

The specific surface area of the fibers is greater than 3 $m^2/g$, preferably 6 $m^2/g$ and particularly preferably 10 $m^2/g$.

Advantageously, when the fibers are refined, they are refined to a freeness, expressed in ° SR, which is greater than or equal to 30, preferably 40 and particularly preferably 50.

According to the invention, the composite product comprises a loading of crystals of precipitated calcium carbonate (PCC) which is greater than or equal to 20, preferably 30 and particularly preferably 40% by weight, based on total solids.

One process for obtaining the novel composite product, such as that shown in FIGS. 1 to 3, consists in placing an aqueous suspension of fibrous materials of hydrophilic character, for example eucalyptus cellulose fibers refined to 40° SCHOPPER-RIEGLER, in an appropriate reactor. Such a suspension, containing from 0.1 to 30% by weight of solids in the form of fibers, preferably 2.5% by weight, is introduced into the reactor with simultaneous slow agitation, at a rate of 2 to 60 kg, depending on the desired proportion of PCC, in the knowledge that these quantities correspond respectively to PCC loadings of 90 and 20% by weight, based on the total weight of solids in the composite product.

3 kg of an aqueous suspension of lime (calcium hydroxide), $Ca(OH)_2$, containing 10% by weight of solids, are then introduced into the reactor. The lime thus constitutes the source of the $Ca^{++}$ ions which are brought into contact with the fibers.

According to one advantageous characteristic of the process according to the invention, the ratio $Ca(OH)_2$/fibers, expressed on a dry weight basis, varies from 6:1 to 0.2:1.

With slow agitation, the mixture is then diluted to give a final solids concentration which is less than or equal to 5% by weight, based on the total mass of the mixture, preferably less than or equal to 4% and particularly preferably of the order of 2.5%.

As soon as the mixture has stabilized at a temperature of between 10° and 50° C., for example of about 30° C., vigorous agitation is started by means of a moving element rotating for example at a speed of between 100 and 3000 rpm, especially of the order of 500 rpm, and carbon dioxide is introduced at a rate of 0.1 to 30 $m^3$/h/kg of calcium hydroxide, preferably 15 $m^3$/h/kg. It is from the carbon dioxide introduced that the carbonate ions, $CO_3^{--}$, which are intended to react with the calcium ions, $Ca^{++}$, are formed.

Precipitation then commences and leads to the formation of crystals of calcium carbonate, which can be likened to growth by grafting or nucleation directly on to the fibers, making it possible to obtain a fiber/crystal composite of high mechanical strength.

In the chosen Example, the experimental conditions favor the formation of rhombohedrally shaped crystals. By changing these conditions, it is possible to obtain scalenohedrally shaped crystals.

The reaction continues for 5 to 90 minutes, preferably for about 20 minutes, during which regular control is maintained on the one hand over the pH, which is about 12 at the start of the reaction and drops to 7 at the end of the reaction, and on the other hand over the temperature, which is maintained at about 30° C.

The reactions stops when all the lime has reacted with the carbon dioxide, i.e. when the pH has stabilized at around 7.

Before the reaction, chelating agents such as ethylenediaminetetraacetic acid, or dispersants such as polyacrylamide, can be added to the aqueous suspension of lime.

As shown in FIGS. 1 to 3, the above process makes it possible to obtain regular fine crystals intimately bonded to or directly grafted on to the cellulose microfibrils with a good distribution and a preferential concentration in or on the zones of greatest specific surface area. A comparison of FIGS. 1 to 3 reveals such grafting on cellulose fibers refined to 40° SR (specific surface area of 4.5 $m^2$/g), carrying crystals which, in the Example, constitute a mass of PCC of about 60% by weight, based on total solids. FIGS. 1 to 3 correspond to photographs taken by scanning electron microscopy on samples which have been dried beforehand by the so-called critical point technique.

The critical point desiccation method consists in carrying out the following methodology as:

Phase no. 1: dehydration (ambient pressure and temperature):

Before being subjected to the desiccation operation, the samples to be analyzed are first dehydrated by successive passes through solutions of acetone (or ethanol) of increasing concentration (30, 50, 70, 90, 100%).

Phase no. 2: substitute liquid (temperature: 10° C., pressure: 50 bar):

The sample prepared in this way is introduced into the drying cell of the apparatus, the cell being filled with acetone (or ethanol). Several successive washes are then carried out with a substitute liquid ($CO_2$ in the present case) in order to remove all the acetone (ethanol).

Phase no. 3: desiccation (temperature: 37° C., pressure: 80 bar):

The temperature of the enclosure is then raised to 37° C., bringing the pressure to 80 bar. The $CO_2$ thus changes from the liquid state to the gaseous state without crossing a phase boundary.

After evacuation of the $CO_2$ gas, the sample is ready for observation by electron microscopy.

The instrument used is of the CPD 030 type marketed by BOIZIAU DISTRIBUTION.

Figure 4:
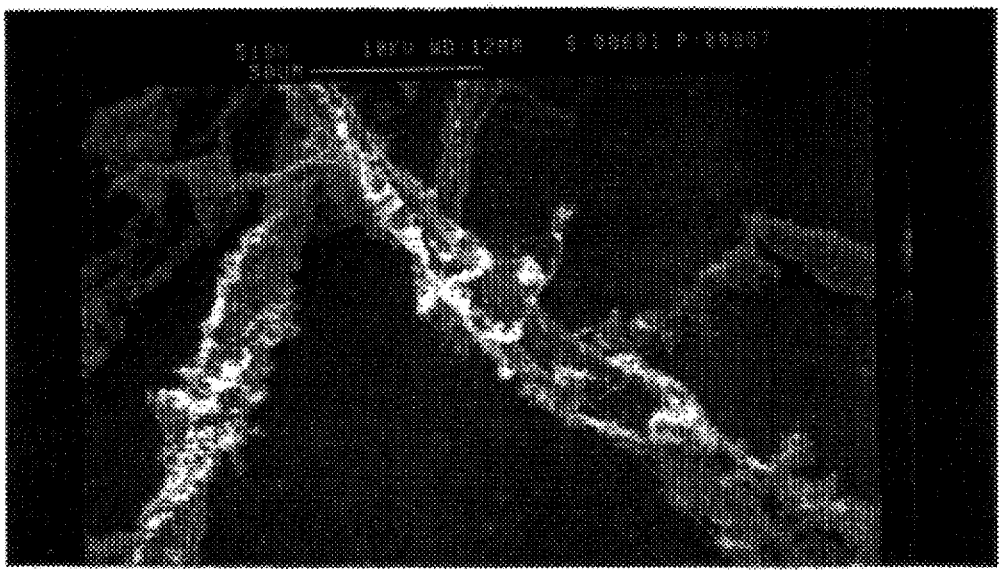
FIGS. 4 to 6 are similar SEM photographs of the same product obtained with eucalyptus cellulose fibers refined to 60° SCHOPPER-RIEGLER (SR).
Figure 5:
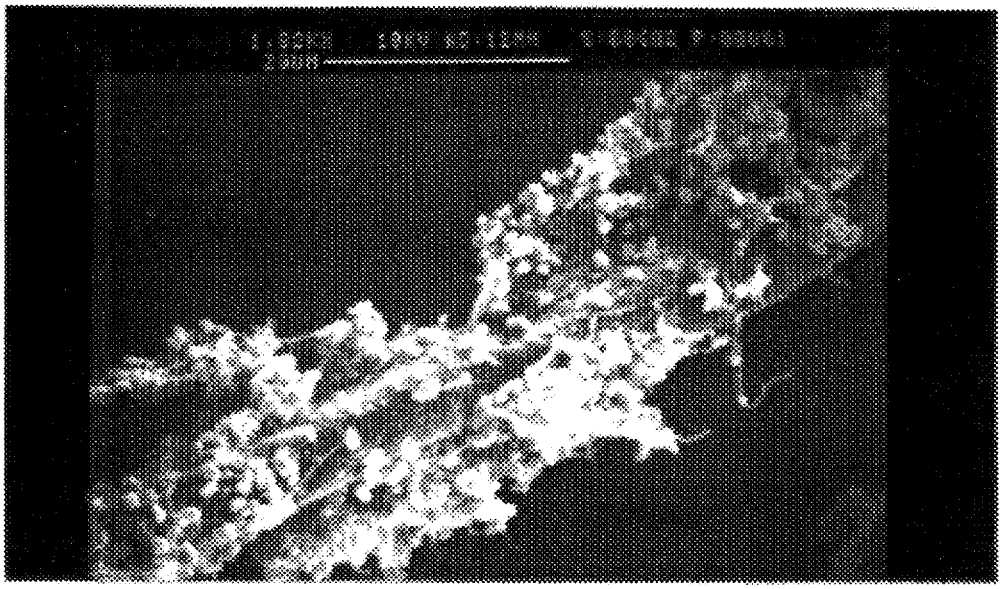
Figure 6:
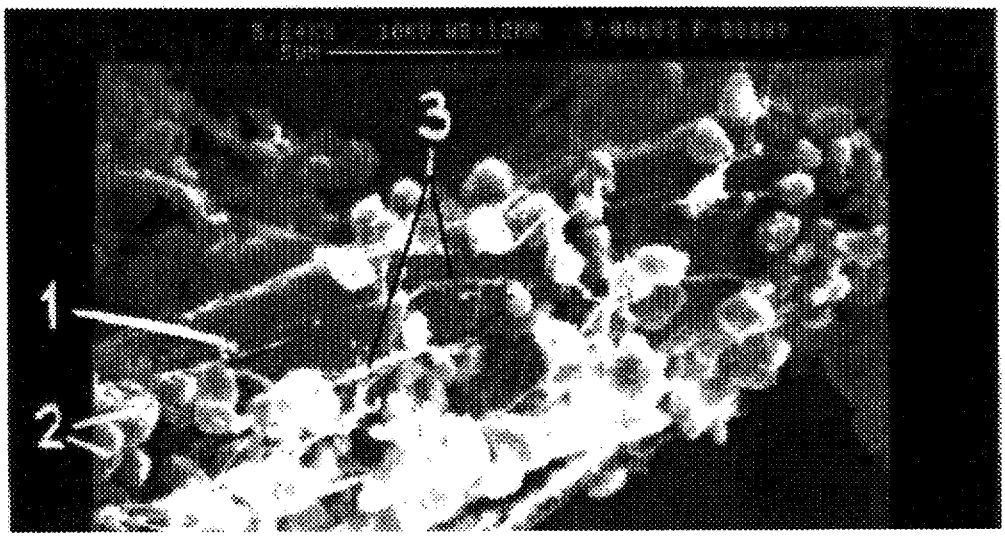

FIGS. 4 to 6, compared with FIGS. 1 to 3, show precipitated crystals intimately bonded to the microfibrils in a more homogeneous manner. These Figures correspond to products obtained from cellulose fibers, more particularly eucalyptus fibers, refined to 60° SR, whose specific surface area is 6 $m^2$/g and on which a PCC nucleation of 60% by weight of solids has been produced by the process described above.

These FIGS. 4 to 6 were prepared under the same conditions and according to the same parameters as FIGS. 1 to 3.

Figure 7:
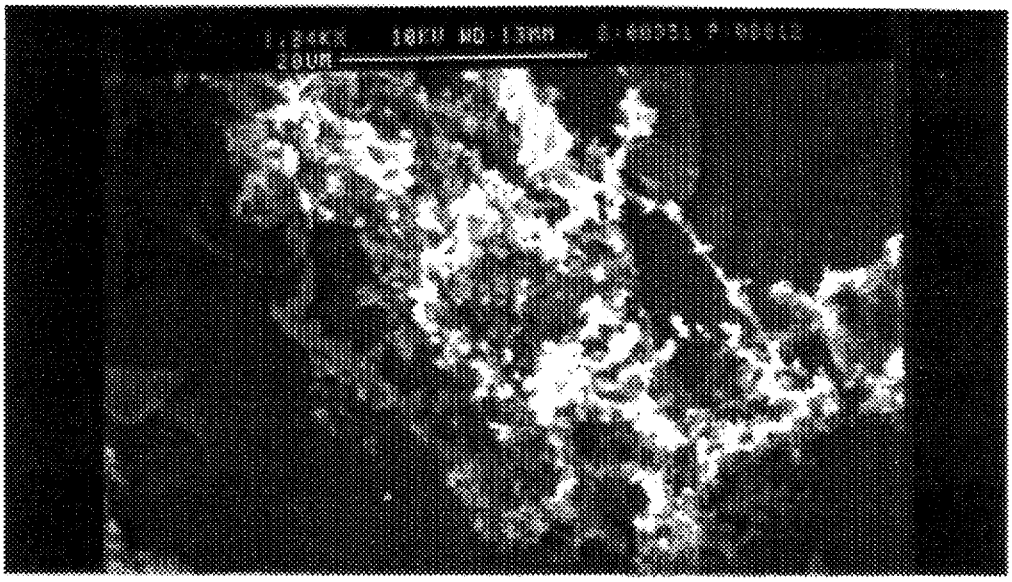
FIGS. 7 to 9 are similar SEM photographs of the same product obtained with eucalyptus cellulose fibers refined to 95° SR.
Figure 8:
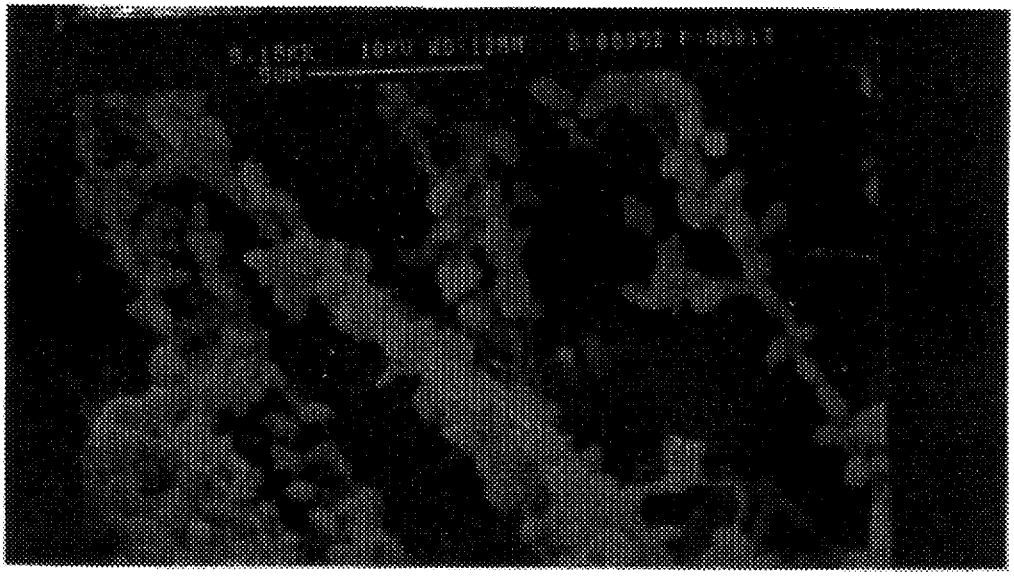
Figure 9:
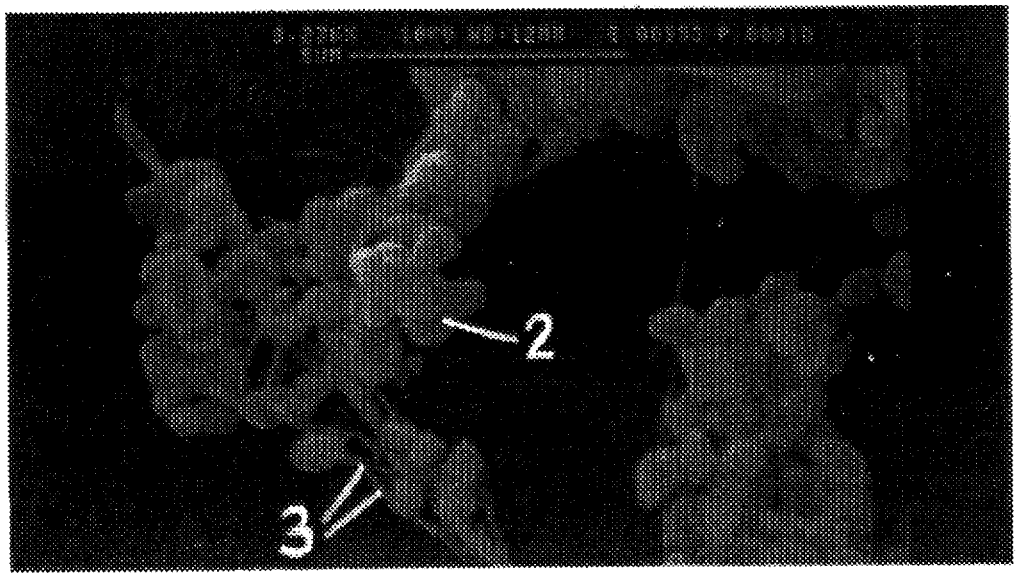

FIGS. 7 to 9 correspond to photographs taken by scanning electron microscopy, at respective magnifications of 1840, 5150 and 8230, of composite products obtained from eucalyptus fibers refined to 95° SR (specific surface area of 12 $m^2$/g).

The same operating conditions were selected in this case.

A comparison of these three increasing levels of refining, namely FIGS. 1 to 3, FIGS. 4 to 6 and FIGS. 7 to 9 respectively, show the correlative increase in the number of microfibrils.

Figure 10:
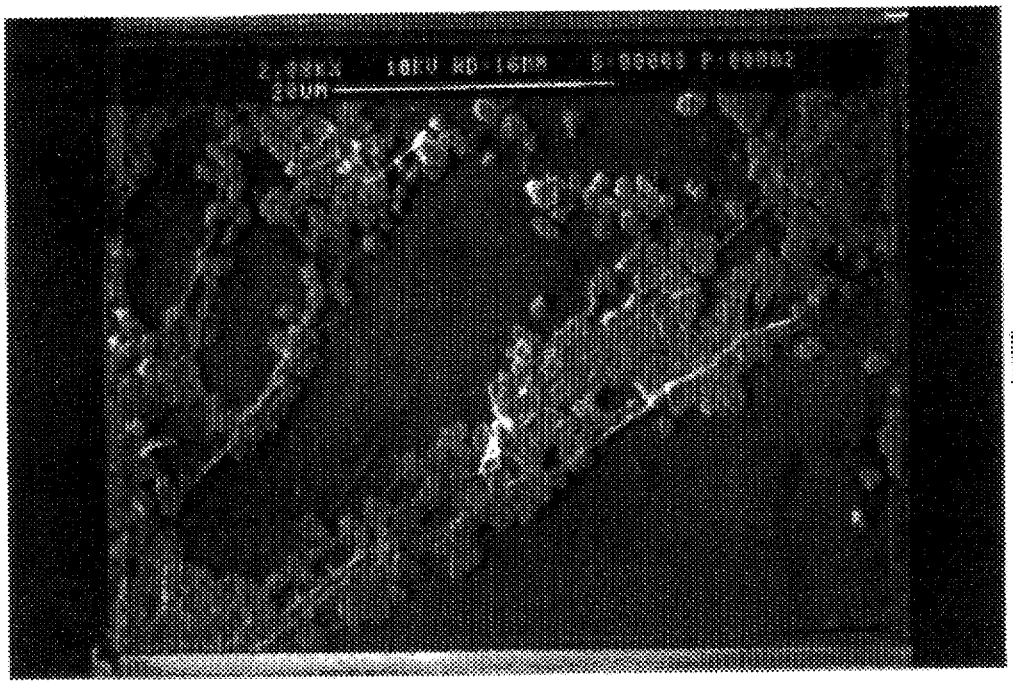
FIGS. 10 and 11 are SEM photographs comparable to photographs 7 to 9 and corresponding to a higher loading of mineral material.
Figure 11:
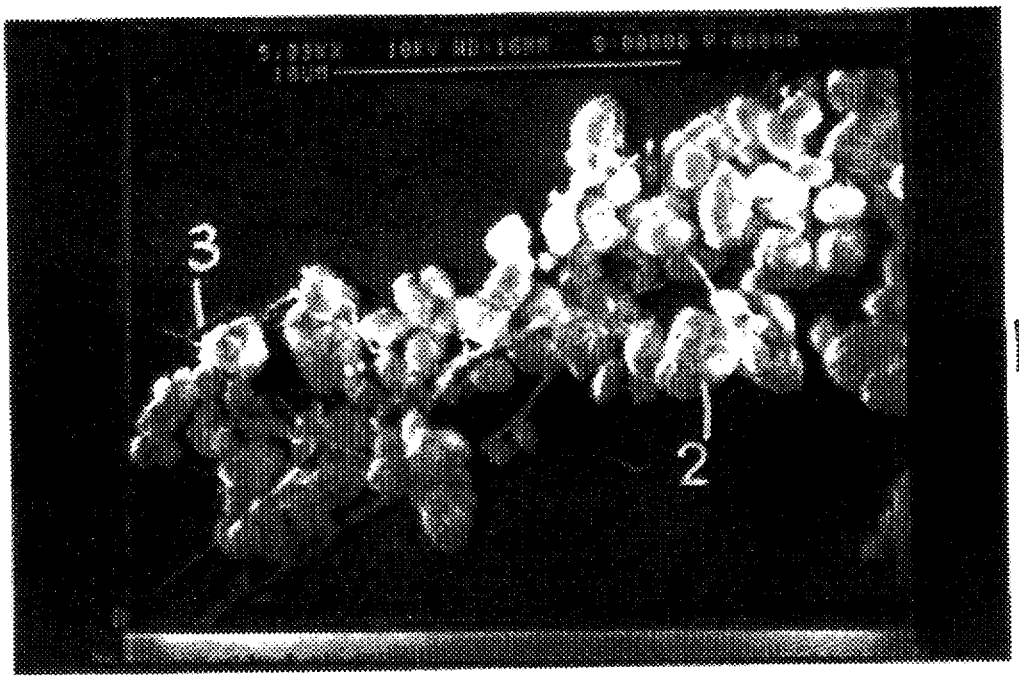

FIGS. 10 and 11 are also photographs of a composite obtained from eucalyptus fibers refined to 95° SR and subjected to the grafting of a filler of PCC crystals. The loading of this composite is about 85% by weight, based on the weight of total solids.

Figure 12:
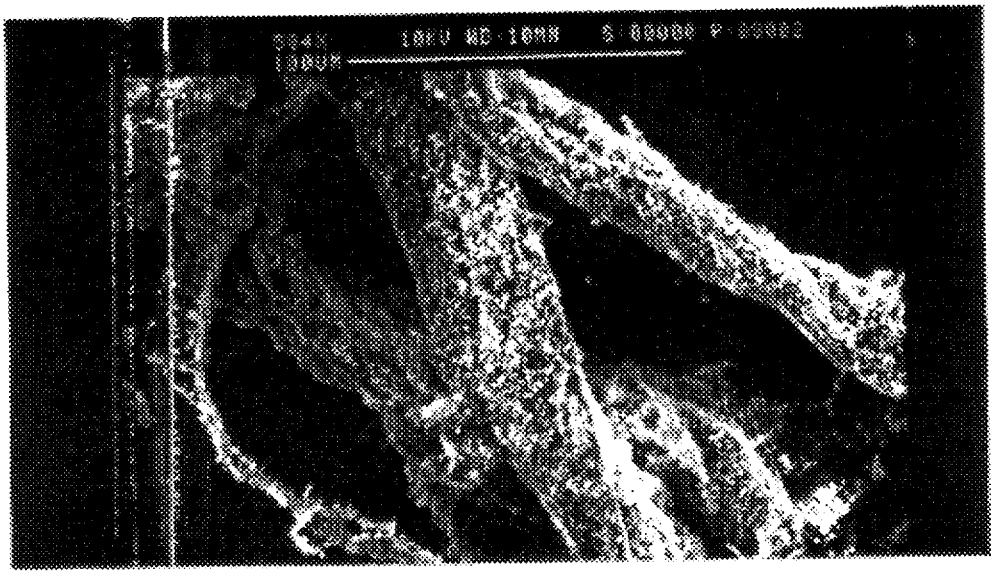
FIGS. 12 to 14 are SEM photographs, at different magnifications, of a composite product based on pine fibers refined to 60° SR.
Figure 13:
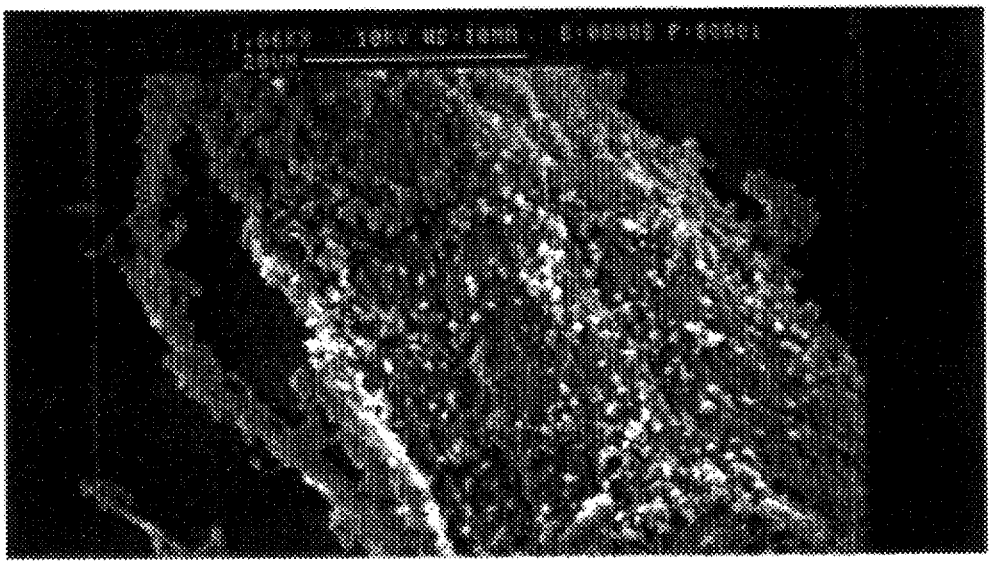
Figure 14:
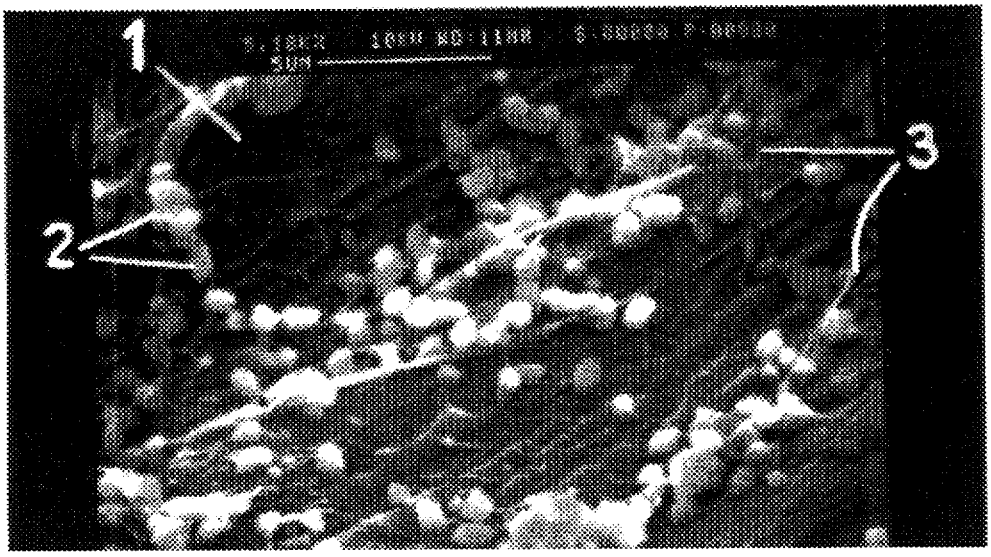

FIGS. 12 to 14 show the application of the process to pine fibers refined to 60° SR (specific surface area of 6.5 $m^2$/g), on which a final PCC crystallization of 65% by weight of solids has been effected.

The composite product formed has a similar appearance to those of the previous Examples as regards the structure, the distribution and the homogeneity of the PCC crystals, as well as the shape of these crystals.

Figure 15:
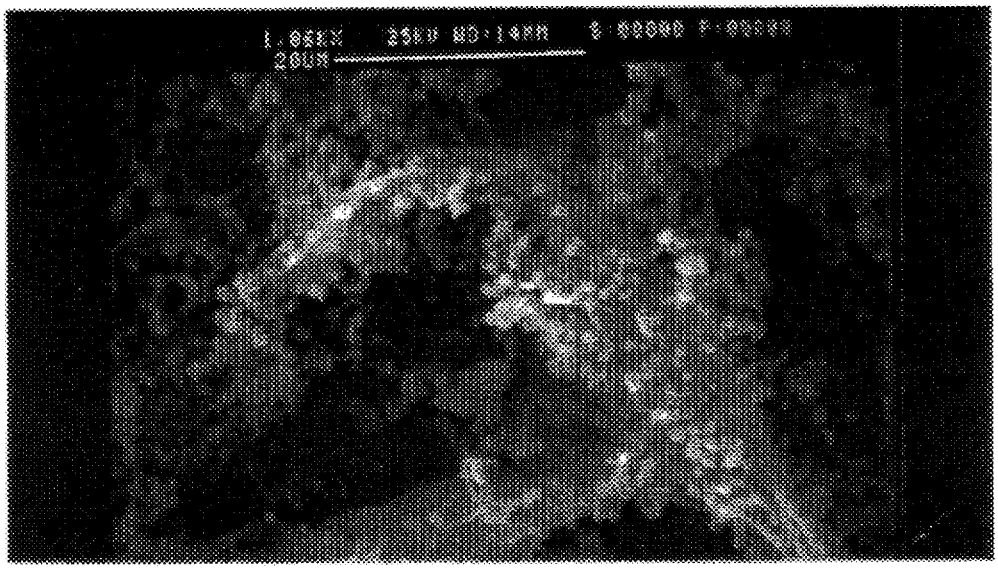
FIGS. 15 to 17 are SEM photographs, at different magnifications, of a composite product based on beech fibers refined to 95° SR.
Figure 16:
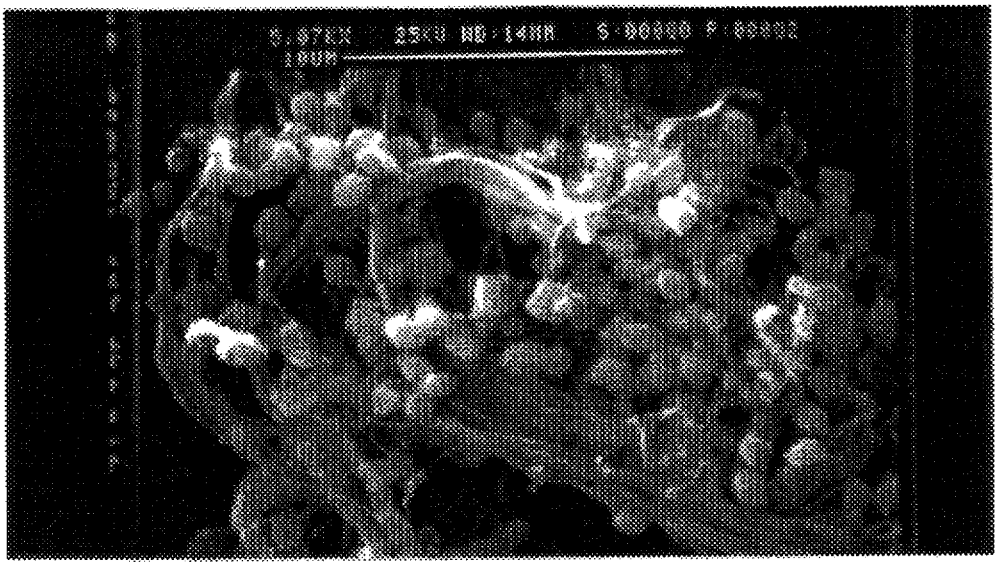
Figure 17:
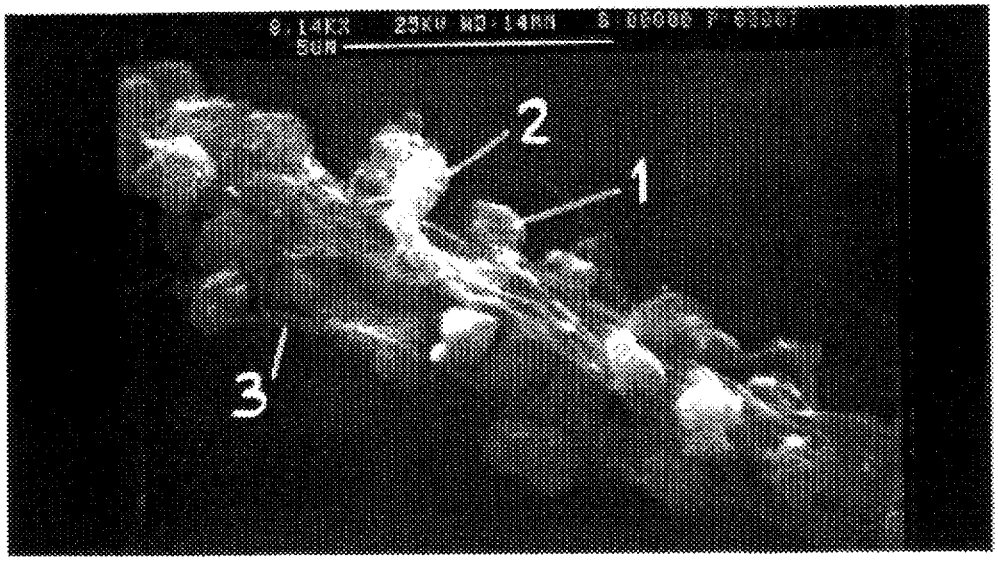

FIGS. 15 to 17 are photographs, at magnifications of 1860, 5070 and 8140, showing composite products obtained from beech fibers refined to 95° SR (12 $m^2$/g), on to which a loading of PCC crystals of about 75% by weight of solids has been grafted.

Figure 18:
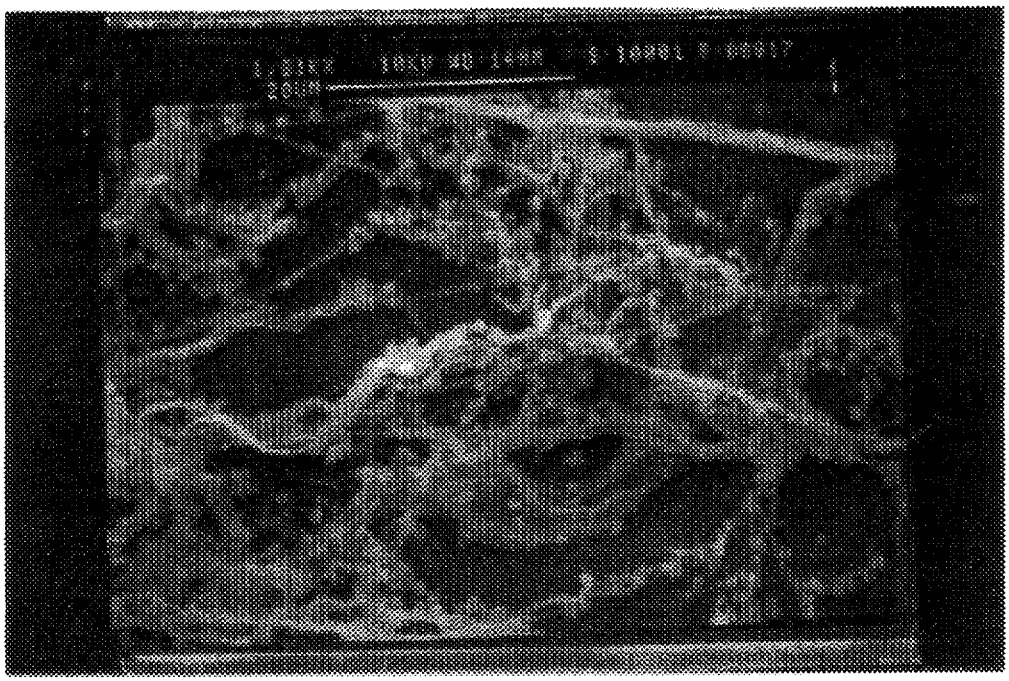
FIGS. 18 and 19 are SEM photographs, at different magnifications, of a composite product based on synthetic cellulose acetate fibers. The product used in this case naturally contains microfibrils.
Figure 19:
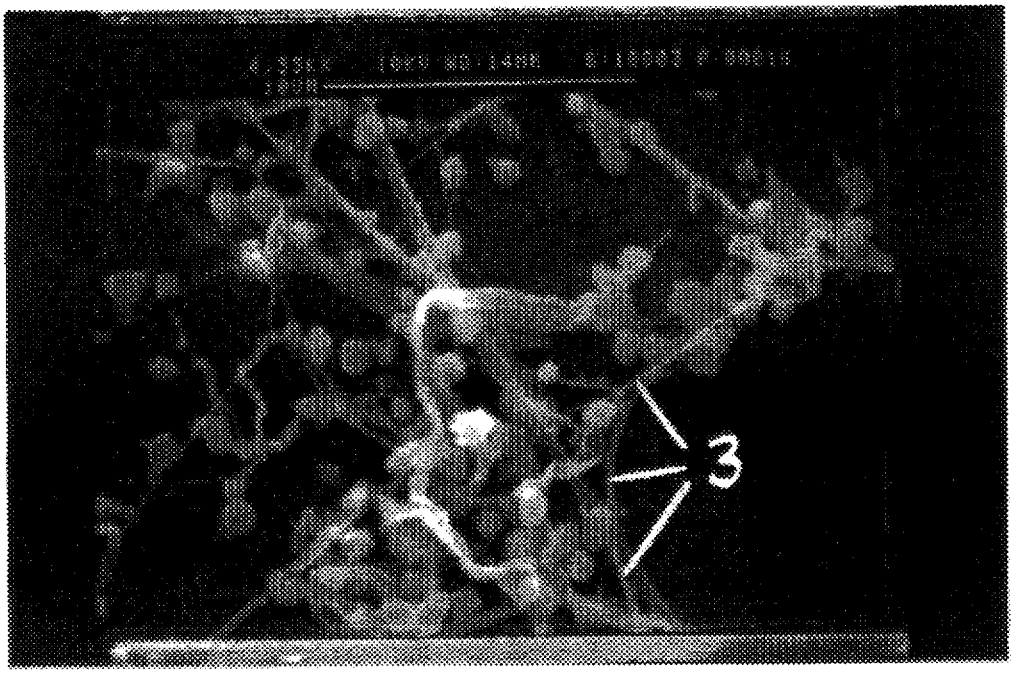

FIGS. 18 and 19 show a further embodiment of a composite product according to the invention, obtained from synthetic fibers, more particularly cellulose acetate fibers such as those marketed under the reference "FIBRET" by HOECHST CELANESE. Such a product consists of microfibrils with a specific surface area of about 20 $m^2$/g. These microfibrils were used as such and were not subjected, prior to the process, to refining by fibrillation.

The process was carried out in the manner stated above and the growth of PCC crystals was effected under conditions such that the composite product contained 60% by weight of mineral material, based on solids.

Figure 20:
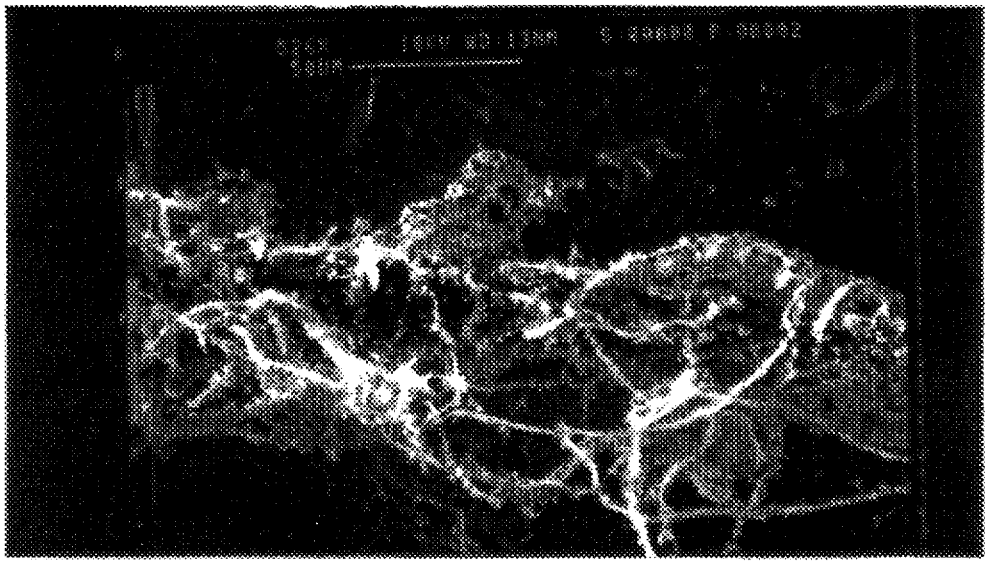
FIGS. 20 to 22 are SEM photographs, at different magnifications, of a composite product based on acrylic fibers.
Figure 21:
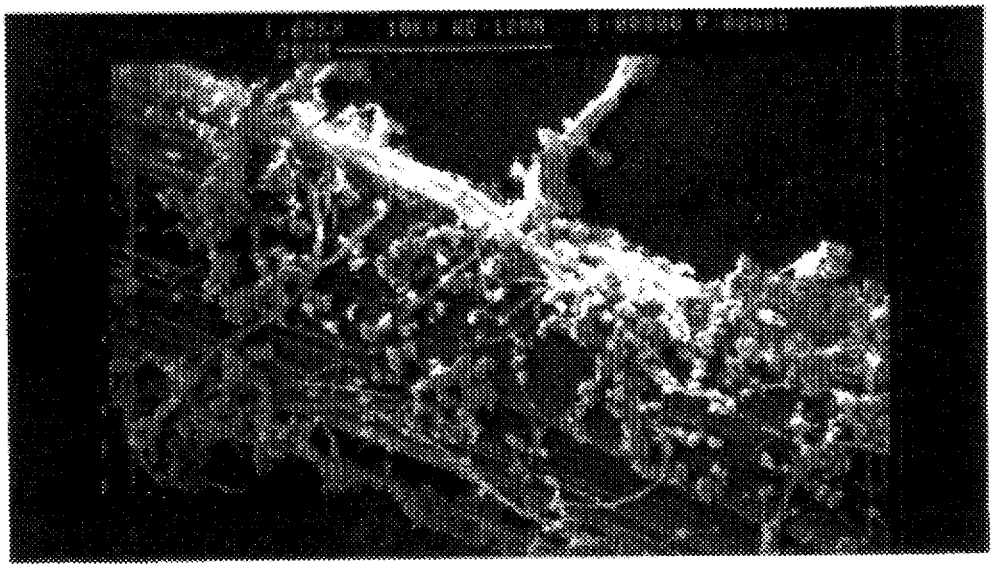
Figure 22:
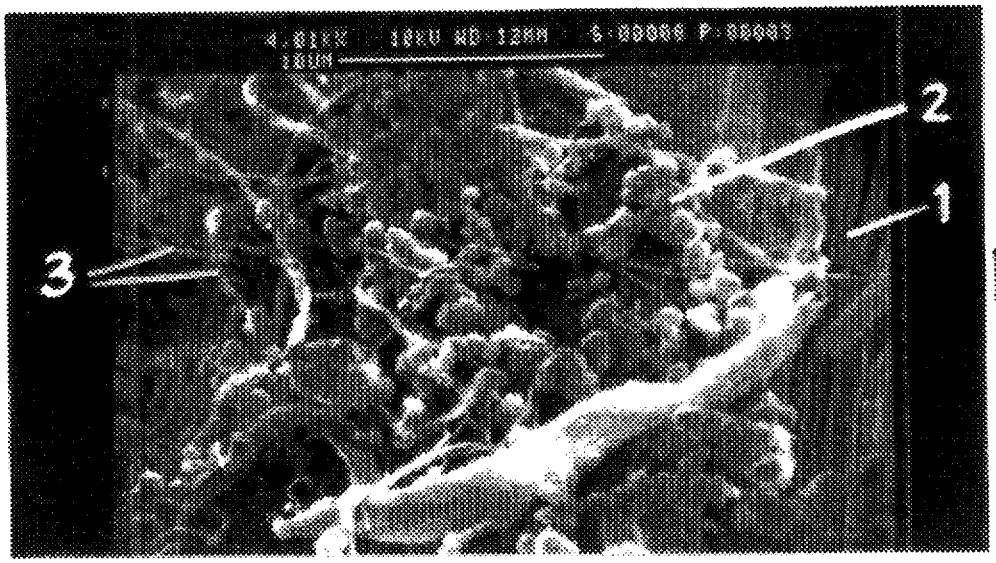

FIGS. 20 to 22 are photographs, at magnifications of 526, 1650 and 4010, of a composite product made up of synthetic fibers such as the acrylic fibers marketed under the reference "APF Acrylic Fibers" by COURTAULDS. Such fibers were refined in a VALLEY beater so as to have a high degree of fibrillation corresponding to a specific surface area of about 6 $m^2$/g. As a comparative reference, such fibers, which naturally have a freeness of the order of 13° SR, were refined to 17° SR. Crystallization effected under the conditions described above gave a final product containing 75% by weight of PCC, based on the weight of solids, whose crystals have similar shapes and dimensions to those of the previous Examples.

An analysis of FIGS. 18 to 22 reveals the same general appearance of crystallization as far as the shape of the crystals, the distribution and the homogeneity are concerned.

Figure 23:
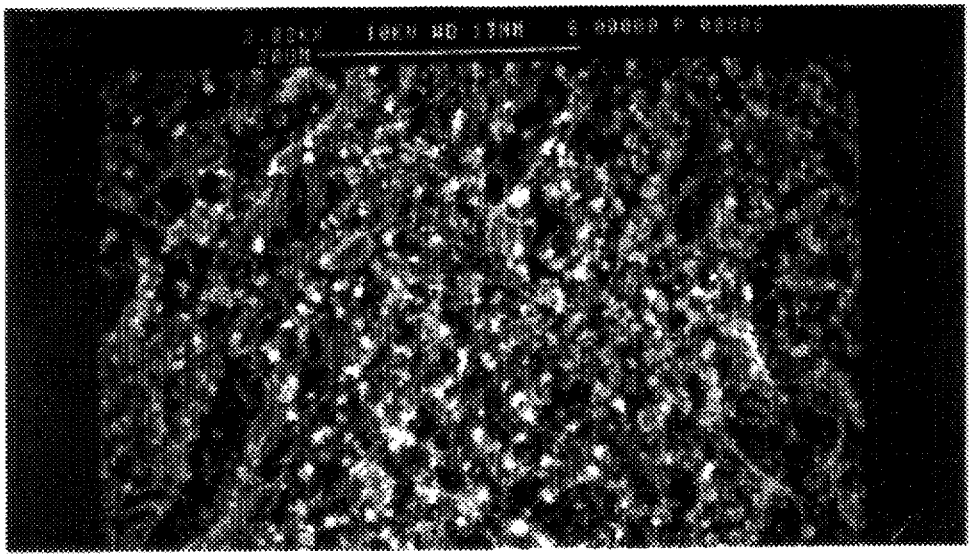
FIGS. 23 to 25 are SEM photographs, at different magnifications, of a composite product based on cellulose fibers of bacterial origin, naturally containing microfibrils.
Figure 24:
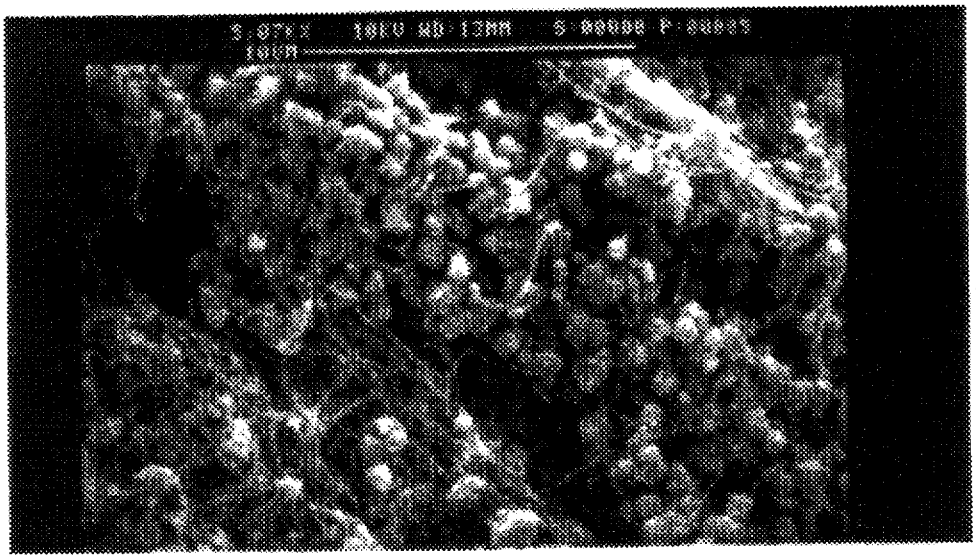
Figure 25:
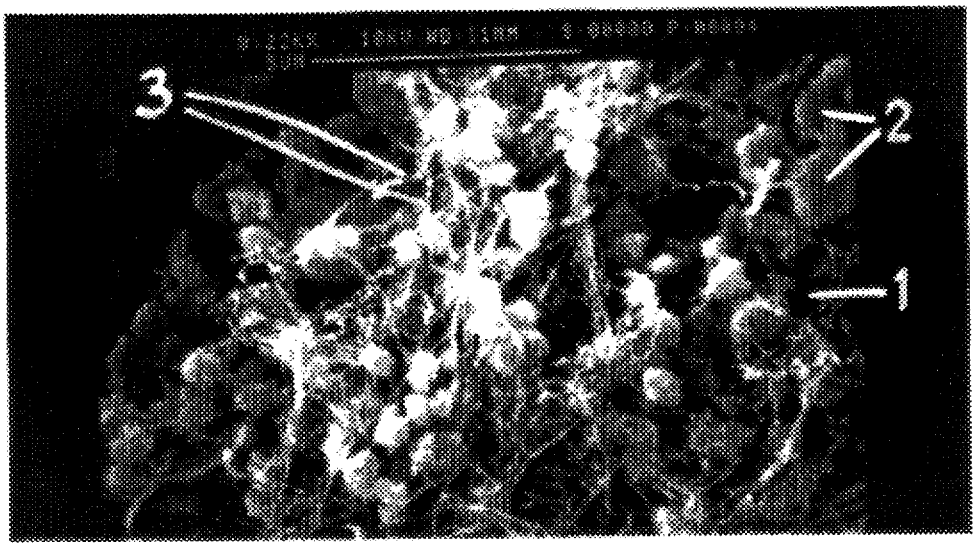

FIGS. 23 to 25 illustrate a novel embodiment of a composite product consisting of cellulose fibers of bacterial origin, marketed under the registered trademark "CELLULON" by WEYERHAEUSER. These cellulose fibers, which have a high specific surface area of the order of 200 $m^2/g$ and are presented in the form of a thick paste, do not require a prior fibrillation treatment by mechanical refining.

On the other hand, they do need to be dispersed with the aid of an apparatus of the "mixer" type (speed of rotation of the order of 1000 rpm), in the presence or absence of a dispersant such as carboxymethyl cellulose (CMC). This product is prepared and used at concentrations of about 0.4% by weight of solids.

Crystallization effected under the conditions described above gave a final product containing 72% by weight of PCC, based on the weight of total solids.

As is apparent from the foregoing description, the invention makes it possible to produce a synthetic, cellulosic composite product which can contain a greater or lesser loading of mineral material, according to the percentage by weight of crystals attached directly to the fibers. Such a product does not include a retention aid and can be obtained by carrying out a simple and inexpensive process which can be mastered without hidden difficulties.

Such a composite product can be used as a raw material for the production of construction materials which must possess specific characteristics of strength, inertness and flame resistance. In such an Application Example, despite the low proportion of fibers present in the composition, it becomes possible, when the fibers employed have a sufficiently open structure, to produce a self-bonding mineral material exhibiting good cohesion.

In the field of construction materials, the composite product according to the invention can be produced in the form of boards, facings, bricks, tiles, etc.

Another field of application is the paper industry. The composite product, as an aqueous suspension or a paste with a solids concentration of 40% by weight, can be used in a mixture with a traditional fiber suspension to give highly loaded conventional papers. In this application, a mixture of a suspension of traditional fibers and a suspension according to the invention is then produced in accordance with the physical characteristics of the products to be obtained. The retention of the fillers in the paper compared with the initial composition is then greater than that conventionally obtained, to the extent of at least 10 to 20 points. This is what is understood, in terms of the present invention, by the expression "highly" loaded paper product.

The invention also permits the manufacture, by a wet process, of substrates or networks of opacified non-woven fibers, in which it is possible to achieve a greater proportion of mineral fillers than by the current techniques.

The invention is not limited to the Examples described and shown, it being possible to make various modifications thereto without departing from the framework of the invention.

What is claimed is:

1. A fiber-based composite material comprised of:

a fiber component including a plurality of fibers of expanded specific surface area and hydrophilic character, having microfibrils on their surface;

wherein said surface area of said fibers are in the range of 3 to 200 $m^2/g$; and a mineral component bonded to said fiber component which includes crystals of precipitated calcium carbonate (PCC);

wherein said crystals of PCC are organized essentially in clusters of granules directly grafted on to said microfibrils, without binders or retention aids present at the interface between PCC and microfibrils, so the majority of said crystals trap said microfibrils by reliable and non-labile mechanical bonding;

said mineral component is equal to or greater than 20% by weight, based on total solids of the composite material.

2. A fiber-based composite material according to claim 1, wherein said microfibrils have a diameter of less than 5 μm.

3. A fiber-based composite material according to claim 1, wherein the particle size of said crystals of PCC are in the range of 0.5 to 10 μm.

4. A fiber-based composite material according to claim 1, wherein said fibers are natural or refined.

5. A fiber-based composite material according to claim 1, wherein said fibers are refined to a freeness greater than 30° Schopper-Riegler.

6. A fiber-based composite material according to claim 1, wherein said mineral component is between 20 to 40% by weight, based on total solids of the composite material.

7. A fiber-based composite material according to claim 1, wherein said mineral component is greater than 40% by weight, based on total solids of the composite material.

8. A fiber-based composite material according to claim 1, wherein said fibers are selected from the group consisting of cellulosic and synthetic fibers.

9. A fiber-based composite material according to claim 1, wherein the composite material is an aqueous suspension, a paste or a compact mass.

10. A fiber-based composite material according to claim 1, wherein said composite material is used to produce construction materials, paper products or opacified non-woven substrates.

* * * * *